United States Patent [19]

Lim

[11] Patent Number: 4,652,322

[45] Date of Patent: Mar. 24, 1987

[54] PROCESS FOR BONDING AND STRETCHING NONWOVEN SHEET

[75] Inventor: Hyun S. Lim, Chesterfield, Va.

[73] Assignee: E. I. Du Pont de Nemours and Company, Wilmington, Del.

[21] Appl. No.: 835,011

[22] Filed: Feb. 28, 1986

[51] Int. Cl.[4] ..... B29C 55/06

[52] U.S. Cl. ..... 156/181; 156/229; 156/282; 156/311; 264/288.8

[58] Field of Search ..... 156/181, 229, 282, 290, 156/311; 264/288.8

[56] References Cited

U.S. PATENT DOCUMENTS 3,169,899 2/1965 Steuber ..... 264/167

3,402,227 9/1968 Knee ..... 264/24

4,537,733 8/1985 Farago ..... 264/9

4,554,207 11/1985 Lee ..... 428/288

*Primary Examiner*—James Lowe

[57] ABSTRACT

Fibrous polyolefin nonwoven sheets are bonded and stretched in a continuous, multiple stage process. First, the sheet is heated without significant stretching to a temperature that is close to, but below, the melting temperature of the polyolefin. Then, as the sheet is forwarded to a first stretching stage, the sheet temperature is decreased by 5° to 40° C. and thereafter the sheet is alternately heated and cooled as it passes through successive stretching stages, before final cooling to below 60° C. In comparison to similar sheets bonded and stretched at constant temperature, the sheets produced by the process of the present invention are significantly more uniform in thickness.

6 Claims, 1 Drawing Figure

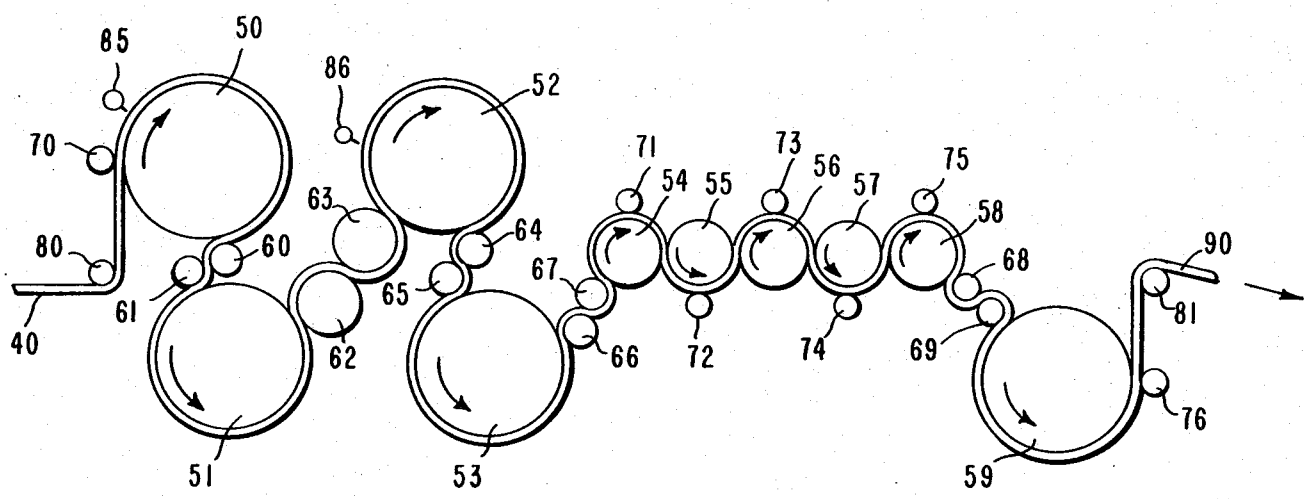
90
81
76
59
68
69
58
75
57
74
56
73
55
72
54
71
66
67
53
52
64
65
86
63
62
50
60
51
85
61
70
80
40

PROCESS FOR BONDING AND STRETCHING NONWOVEN SHEET

BACKGROUND OF THE INVENTION

1. Field of the Invention

This invention relates to a continuous process for bonding and stretching a fibrous polyolefin nonwoven sheet. In particular, the invention concerns such a process wherein the sheet temperature is varied during the stretching. When the bonding and stretching are performed without such temperature variation, the resultant sheet is significantly less uniform in thickness than sheet prepared in accordance with the present process.

2. Description of the Prior Art

Processes for manufacturing fibrous nonwoven sheets from polyolefin polymers are well known in the art. For example, steuber, U.S. Pat. No. 3,169,899 discloses depositing flash-spun plexifilamentary strands of polyethylene film fibrils onto a moving receiver to form a nonwoven sheet. Methods for assembling fibers deposited from a plurality of positions onto a moving receiver are disclosed by Knee, U.S. Pat. No. 3,402,227 and Farago, U.S. Pat. No. 4,537,733.

Several methods are known in the art for bonding and stretching fibrous polyolefin nonwoven sheets. A particularly useful method, especially suited for use in making lightweight nonwoven sheets of polyethylene plexifilamentary film-fibril strands, is disclosed by Lee, U.S. Pat. No. 4,554,207. Lee discloses a process that includes (a) forming a sheet of flash-spun, polyethylene plexifilamentary film-fibril strands, (b) lightly consolidating the thusly formed sheet, (c) heating the sheet without significant stretching to a temperature that is in the range of 3° to 8° C. below the melting point of the polyethylene, (d) then, while maintaining the sheet at that temperature, stretching the sheet in at least two stages to at least 1.2 times its original length and (e) finally, cooling the heated-and-stretched sheet to a temperature of less than 60° C., preferably by first cooling through one surface of the sheet and then through the opposite surface. At substantially all times when the sheet temperature is 100° C. or higher during the heating, stretching and cooling steps, forces are applied perpendicular to the surface of the sheet to restrain transverse shrinkage of the sheet. The process of Lee is illustrated with the simultaneous bonding and stretching of a fibrous polyethylene nonwoven sheet by passage over a series of heated rolls which reduces the unit weight of the sheet by as much as a factor of two.

The aforementioned methods have been technically useful and commercially successful in the manufacture of wide nonwoven sheets, particularly of polyethylene plexifilamentary film-fibril strands (e.g., "Tyvek" spunbonded olefin, manufactured by E. I. du Pont de Nemours & Co.). However, sheet uniformity problems are encountered in the known manufacturing processes, especially when lightweight sheets are made. Thin and thick areas are sometimes encountered in the lightweight sheets.

An object of the present invention is to provide an improved process for making a bonded-and-stretched fibrous polyolefin sheet that has improved thickness uniformity, even in very light unit weights.

SUMMARY OF THE INVENTION

The present invention provides an improved continuous process for bonding and stretching a fibrous polyolefin nonwoven sheet. The process is of the type in which the nonwoven sheet first is heated to a bonding temperature that is near but below the melting point of the polyolefin, the heated sheet is then stretched to at least 1.2 times its original length in at least two stages, and then the stretched sheet is cooled to a temperature below 60° C. At substantially all times when the sheet is at a temperature of 100° C. or higher during the heating, stretching and cooling steps, forces are applied perpendicular to the sheet surface. The improvement of the present invention is characterized from this known process in that immediately after the sheet has been heated without significant stretching and is being advanced to the first stretching stage, the sheet temperature is decreased by 5° to 40° C. and then the sheet is subjected alternately to heating and cooling in the subsequent stretching stages of the process. Preferably, the sheet temperature is decreased from the bonding temperature by 10° to 25° C. as it is being forwarded to the first stretching stage. Generally, during the alternate heating and cooling of the sheet during the subsequent stretching, the sheet temperature is increased to no higher than the bonding temperature and decreased to no lower than 100° C. Preferably, the sheet temperature varies during the alternate heating and cooling by at least 5° C. and by no more than 35° C. Most preferably, the sheet temperature varies by 10° to 25° C. during the alternate heating and cooling.

BRIEF DESCRIPTION OF THE FIGURE

The invention will be further understood by reference to the attached drawing which is a schematic flow diagram of a preferred, multiple heated-roll apparatus for carrying out the improved bonding-and-stretching process of the present invention.

DETAILED DESCRIPTION OF PREFERRED EMBODIENTS

The present invention will now be described and illustrated in detail with regard to a preferred method for bonding and stretching a wide, lightweight, nonwoven sheet of polyethylene plexifilamentary film-fibril strands. The process is of the general type described in detail in Lee, U.S. Pat. No. 4,554,207, the entire disclosure of which is hereby incorporated herein by reference. Although the present description will be directed primarily to the processing of such a fibrous polyethylene nonwoven sheet, in its broadest aspect, the present invention is intended to embrace the processing of other fibrous polyolefin materials. These include fibrous sheets, webs, and other like nonwoven fabrics made of homopolymers of ethylene, propylene and the like and copolymers thereof.

The known processes for bonding and stretching fibrous polyolefin nonwoven sheets include the steps of heating the sheet without significant stretching to a bonding and stretching temperature that is close to but below the melting point of the polyolefin. For example, the polyethylene plexifilamentary nonwoven sheets of U.S. Pat. No. 4,554,207 are heated to a temperature that is in the range of 3° to 8° C. below the melting point of the polyethylene and then during two or more stretching stages is maintained at, or very near, that temperature before the final step of cooling without stretching. At all times while the temperature of the sheet is at a temperature of 100° C. or higher, forces are applied perpendicular to the surface of the sheet to prevent excessive transverse shrinkage.

The process of the present invention is an improvement over the process just described. During the stretching of the sheet in two or more stages, instead of maintaining the sheet substantially constant at a temperature that is within 3° to 8° C. below the melting point of the polyolefin, in accordance with the present invention, the temperature of the sheet is first decreased, usually by 5° to 40° C., as the sheet enters the first stretching stage, and then during the further stretching, the sheet is alternately heated and cooled, so that the sheet temperature is varied over a 5° to 35° C. wide temperature range, before the final cooling to a temperature below 60° C. During the alternate heating and cooling during stretching, the sheet temperature is usually maintained no higher than the initial bonding temperature to which the sheet was heated and is usually not decreased below 100° C. Although the lower temperatures of these ranges can be tolerated by the sheet for short transient periods during stretching, maintaining the temperature of the sheet at low temperature for a longer period of time leads to excessive stresses and tearing of the sheet.

In order to obtain the greatest benefits from the process of the present invention with regard to sheet thickness uniformity, operation in the upper portions of the set forth temperature ranges is preferred. Accordingly, preferred ranges for the inital reduction in temperature from the temperature that is near the melting point of the polyolefin and for the temperature variation thereafter are respectively 10° to 30° C. and 15° to 25° C. During the stretching, the preferred temperatures of alternate heating and cooling vary between 105° and 130° C.

The process of the invention is useful over a wide range of unit weight and stretch ratios for a variety of polyolefin sheets. However, for the preferred plexifilamentary film-fibril strand polyethylene nonwoven sheets, the preferred range of starting weights for the sheets before bonding and stretching is 35 to 70 g/m$^2$; the preferred range of total longitudinal stretch ratios is 1.25 to 1.7; and the preferred number of stretch stages is three or four. Within the general range of starting weights, the process is more effective with lighter weight sheets than with heavier weight sheets.

The sheet temperature referred to herein before is the temperature at the midplane of the sheet cross-section at any particular location along the bonding and stretching process. This temperature may be determined by conventional heat transfer calculations from measurements of the temperatures of the equipment heating the sheet and the surface temperature of the sheet itself. The temperature reported herein at any given roll is that of the sheet midplane after the sheet has travelled over a 120-degree arc of the roll.

Preferred starting materials for the process of the present invention are fibrous nonwoven sheets of flash-spun linear polyethylene plexifilamentary film-fibril strands. These starting sheets can be prepared by the general techniques of Steuber, U.S. Pat. No. 3,169,899 or more particularly by the specific method disclosed in Lee, U.S. Pat. No. 4,554,207 at column 4, line 63 through column 5, line 60.

In accordance with the process of the present invention, a starting sheet is fed into the type of equipment depicted in the schematic flow sheet of the attached drawing and described more specifically in the Examples below. As shown in the drawing, starting sheet 40 is advanced over a series of rolls. The temperature of the sheet is raised from room temperature to the desired bonding temperature by being passed over internally oil-heated steel rolls 50, 51, 52 and 53. As the sheet enters the stretching stages of the equipment, the sheet is cooled by roll 54 and then alternately heated and cooled in the succeeding stretching stages as it is passed in contact with internally oil-heated steel rolls 54, 55, 56 and 57. Rolls 50, 51, 52, 53 and 54 operate so that substantially no stretch is imposed upon the sheet by these rolls. "Substantially no stretch" means that in passage of the sheet from roll 50 to 54, the sheet is maintained under sufficient tension by operating each successive roll at a slightly faster speed than the preceding one, but usually no more than 1% faster. Thereafter, while the sheet is alternately heated and cooled by successive rolls operated with different oil temperatures, the speed of the sheet is increased in passing from roll 54 to 55. from roll 55 to 56 and from roll 56 to 57, to provide three stages of stretch. Then, in succession, cooling is applied to one surface and then the opposite surface of the sheet by internally cooled steel rolls 58 and 59.

At any time when the sheet temperature is at 100° C. or higher during its passage from inlet idler roll 80 to exit idler roll 81, forces are applied perpendicular to the sheet surface to prevent it from shrinking excessively in a transverse direction. As illustrated in the attached drawing, corona discharge wands 85 and 86 place an electrostatic charge on the sheet which causes an attractive force to hold the sheet in close contact with the rolls. Pairs of steel S-wrap rolls 60/61, 62/63, 64/65, 66/67 and 68/69 and rubber-coated nip rolls 70 through 76, as well as the tension placed on the sheet in its passage through the equipment, provide mechanical forces perpendicular to the sheet. These forces also aid in maintaining intimate contact of the sheet with the heating, stretching and cooling rolls. To further minimize transverse shrinkage, the paired S-wrap rolls are positioned to minimize the free unrestrained length of heated sheet (i.e., sheet that is at a temperature of at least 100° C.).

Various sheet characteristics have been referred to herein and are also mentioned in the Examples below. These characteristics are determined by the following methods. In the test method descriptions, ASTM refers to the American Society of Testing Materials, TAPPI refers to the Technical Association of Pulp and Paper Industry, and AATCC refers to the American Association of Textile Chemists and Colorists.

Unit weight is measured in accordance with TAPPI-410 OS-61 or ASTM D3776-79 and is reported in g/m$^2$.

Tensile properties are measured in accordance with TAPPI-T-404 M-50 or ASTM D1117 1682-64 and are reported in Newtons. Note that the tests are performed on 1-inch (2.54-cm) wide strips.

Elmendorf tear strength is measure in accordance with TAPPI-T-414 M-49 and is reported in Newtons.

Delamination resistance is measured by using an Instron Tester, 2.5 cm×7.2 cm line contact clamps, and an Instron Integrator, all manufactured by Instron Engineering, Inc., of Canton, Mass. Delamination of a 2.5 cm×17 cm specimen is started manually across a 2.5 cm×2.5 cm edge area at about the midplane of the sheet by splitting the sheet with a pin. One end of one of the split layers is placed in one of the line clamps and the corresponding end of the other split layer is placed in the other line clamp and the force to pull the sheet apart is measured. The following Instron settings are used with a "C" load cell: gauge length of 10.1 cm; crosshead speed of 12.7 cm per minute; chart speed of 5.1 cm per minute; and full scale load of 0.91 kg. Delamination resistance equals the integrator reading divided by the appropriate conversion factor which depends on the load cell size and the units of measurement. Delamination is reported in Newtons/cm.

Gurley-Hill permeability is measured in accordance with TAPPI-T-460 M-49 and is reported in sec/100cm$^3$/cm$^2$.

Hydrostatic head is measured in accordance with AATCC 127-77 and is reported in centimeters.

Opacity is determined by measuring the quantity of light transmitted through individual 5.1-cm (2-in) diameter circular portions of sheet. An E. B. Eddy Opacity Meter, manufactured by the Thwing Albert Instrument Company is used for the measurement. The opacity of the sheet is determined by arithmetically averaging at least 15 such individual determinations. An opaque sheet has a measured opacity of 100%.

Thickness, as well as unit weight, can be determined with a nuclear weight sensor such as a Measurex 2002 beta gauge manufactured by Measurex Systems, Inc. of Cupertino, Calif. Such a gauge was used for measuring the thickness of the sheets produced in the examples. About 27,000 points are measured on a 3 foot×10 foot (0.91 m×3.05 m) sample to determine the average thickness or unit weight and the standard deviation of the data. The thickness uniformity is reported as a coefficient of variation, which is the statistically determined standard deviation of the measurements, expressed as a percentage of the average value.

Temperature of the sheet surface can be measured with a conventional pyrometer. Temperature of the fluids heating and cooling the rolls can be measured with conventional thermocouples. The temperature of the sheet at its midplane can be calculated from these measurements. For these calculations, the heat transfer characteristics of the roll walls and the nonwoven sheet itself, as well as the heat transfer coefficients from the roll fluid to the roll wall and from the roll surface to the nonwoven sheet, should be known. These can be determined empirically as noted in the Examples below.

The major benefit obtained by use of the present invention in comparison to the prior-art process, in which the bonding and stretching temperature is maintained substantially constant, is in the ability of the present process to produce bonded and stretched sheets of superior thickness uniformity without any significant loss of opacity, strength or other sheet charateristic.

In this paragraph, a hindsight explanation or theory is offered as to why the present stretching process produces an improved sheet uniformity. This explanation is not intended to limit the scope of the present invention, but merely to give a better understanding of it. The present inventor noted that near the melting point of the sheet polymer, a small variation in temperature results in a large change in the stress strain charateristics of the sheet. A small increase in temperature results in the sheet requiring much less tension to stretch it. Conversely, a small decrease in temperature makes the sheet more difficult to stretch. Thus, when a sheet that has small nonuniformities, in the form of thick and thin regions, is heated and cooled during stretching, the thick sections retain their temperature longer and are easier to stretch for a relatively longer period of time than the thin sections. The thin sections lose their heat and temperature more readily and are therefore more difficult to stretch. As a result, when the sheet is stretched, the thicker sections are reduced more in cross-section than are the sections that were originally thinner. The over-all result is a sheet with significantly improved thickness uniformity.

EXAMPLE 1-4

In these examples nonbonded, lightly consolidated, nonwoven sheets of polyethylene plexifilamentary film-fibril strands are bonded and stretched with the sheet temperature being varied during stretching in accordance with the invention. The resultant sheets are compared to those made from the same starting sheet material but stretched and bonded to the same extent at a substantially constant temperature in accordance with the methods of the prior art. The operating speeds and temperatures of the rolls and the sheets are given in Table I. The physical properties of the resultant bonded and stretched sheets are listed in Table II along with the their thickness uniformity. Note the advantageous feature of the invention in providing sheets having much less variation in thickness than do sheets made in accordance with the prior-art method.

The starting sheet used in these examples is made substantially as described in Example 1 of U.S. Pat. No. 4,554,207. The equipment used to stretch sheet to about one-and-a-half times its original length is the same as that described hereinbefore and depicted in the attached drawing. All the rolls shown in the drawing are 1.65 meters long. Rolls 50 through 53 and 59 are each 0.61 meter in diameter. Rolls 54 through 58 are each 0.203 meter in diameter. Nip rolls 70 through 76 and idler rolls 80 and 81 are 0.102 meter in diameter. Corona discharge units 85 and 86 located about 3 cm above the surface of corresponding rolls 50 and 52 are operated at an average voltage of about 11 kilovolts and an average current of about 300 microamps to electrostatically pin the sheets to the rolls. Other operating conditions, temperatures, roll speeds and stretch ratios are given in Tables I and II. Note that samples made in accordance with the invention are labelled with arabic numbers; those made as controls in accordance with the prior art are labelled with capital letters.

Before running the tests described in these examples, roll oil temperatures and sheet surface temperatures were measured as described for the conditions in Example 1 of U.S. Pat. No. 4,554,207. For the sheets used in that example and these Examples 1-4, it was found empirically that the following heat transfer coefficients and thermal properties correlated measured and conventionally calculated temperatures very well. These values were then used to calculate by conventional techniques the midplane temperatures of the sheet at various locations in the process.

| Thermal Properties | Sheet | Roll |
|---|---|---|
| Thermal Conductivitity | | |
| BTU/ft$^2$ · hr · °F./ft | 0.05 | 15 |
| (Watts/m · ° K.) | (0.087) | (26) |
| Heat Capacity | | |
| BTU/lb · °F. | 0.8 | 0.11 |
| (Joule/kg · °K.) | (3350) | (460) |
| Density | | |
| lb/ft$^3$ | 22.6 | 490 |
| (g/cm$^3$) | (0.36) | (7.85) |

Heat Transfer Coefficients
BTU/ft$^2$ · hr · °F.

-continued

| At Rolls | Watts/m² · °K.) 50–50,59 | 54–58 |
|---|---|---|
| Fluid to roll wall | 400 (2270) | 400 (2270) |
| Across roll wall | 720 (4090) | 720 (4090) |
| Roll to sheet | 150 (850) | 100 (570) |
| Across sheet | 470 (2670) | 470 (2670) |
| Sheet to atmosphere | 2.2 (12.5) | 3.5 (19.9) |

The results of the tests and computations show that the operation of the bonding and stretching in accordance with the present invention results in a much more uniform sheet thickness. Comparison of the samples made in accordance with the invention in Examples 1 and 2, wherein the sheet was heated to 132° C., then as it entered the first stretching stage was cooled to 105° C., and then alternately heated and cooled in successive stretching stages, with controls A and B wherein the temperature of the sheet was maintained substantially constant during the stretching after being heated to 132° C., clearly shows the advantage of the process of the invention in producing sheets of better thickness uniformity. Note that in comparison to Sample 1, Control A has thickness coefficient of variation that is 1.27 times larger. Similarly, comparison of the uniformity of the sample and control of Example 2 shows the control to be 1.57 times worse in thickness uniformity. The advantage of the process of the present invention is also shown by similar comparisons in Examples 3 and 4 wherein the control had a larger coefficient of variation in thickness than the sample of the process of the invention by a factor of 1.21 and 1.35, respectively.

TABLE I

OPERATING SPEEDS AND TEMPERATURES

| Roll no. | Speed m/min | Temperature, °C. Sample $T_o$ | Sample $T_s$ | Control $T_o$ | Control $T_s$ | Speed m/min | Temperature, °C. Sample $T_o$ | Sample $T_s$ | Control $T_o$ | Control $T_s$ |
|---|---|---|---|---|---|---|---|---|---|---|
| | Example 1 | | | | | Example 2 | | | | |
| 50 | 29.9 | 93 | 88 | 93 | 88 | 29.9 | 93 | 88 | 93 | 88 |
| 51 | 29.9 | 93 | 90 | 93 | 90 | 29.9 | 93 | 90 | 93 | 90 |
| 52 | 30.5 | 136 | 129 | 136 | 129 | 30.5 | 136 | 129 | 136 | 129 |
| 53 | 30.5 | 136 | 131 | 136 | 131 | 30.5 | 136 | 131 | 136 | 131 |
| 54 | 30.5 | 93 | 105 | 136 | 129 | 30.5 | 93 | 105 | 136 | 129 |
| 55 | 34.1 | 138 | 117 | 138 | 129 | 33.2 | 138 | 117 | 138 | 129 |
| 56 | 37.8 | 116 | 115 | 138 | 130 | 36.0 | 116 | 115 | 138 | 130 |
| 57 | 41.1 | 138 | 122 | 138 | 130 | 38.7 | 138 | 122 | 138 | 130 |
| 58 | 41.5 | 26 | 75 | 26 | 75 | 39.0 | 26 | 69 | 26 | 75 |
| 59 | 41.5 | 13 | — | 13 | — | 39.0 | 13 | — | 13 | — |
| | Example 3 | | | | | Example 4 | | | | |
| 50 | 30.5 | 93 | 88 | 93 | 88 | 30.5 | 93 | 88 | 93 | 88 |
| 51 | 30.5 | 93 | 90 | 93 | 90 | 30.5 | 93 | 90 | 93 | 90 |
| 52 | 31.1 | 135 | 128 | 135 | 128 | 31.1 | 135 | 128 | 135 | 128 |
| 53 | 31.1 | 140 | 136 | 140 | 136 | 31.1 | 140 | 136 | 140 | 136 |
| 54 | 31.1 | 127 | 127 | 138 | 133 | 31.1 | 127 | 127 | 138 | 133 |
| 55 | 36.9 | 138 | 128 | 138 | 131 | 36.9 | 138 | 128 | 138 | 131 |
| 56 | 42.7 | 135 | 128 | 135 | 130 | 36.9 | 127 | 125 | 135 | 130 |
| 57 | 48.8 | 127 | 125 | 135 | 129 | 48.8 | 135 | 125 | 135 | 129 |
| 58 | 49.1 | 26 | 80 | 26 | 83 | 49.1 | 26 | 82 | 26 | 83 |
| 59 | 49.1 | 13 | — | 13 | — | 49.1 | 13 | — | 13 | — |

Notes:
1. $T_o$ is the temperature of the heating oil in the roll.
$T_s$ is the temperature of the surface of the sheet.
2. A blank, —, signifies that the sheet surface temperature was not precisely determined. However, the temperature was below 40° C.

TABLE II

SUMMARY OF DATA

| Example | 1 | | 2 | | 3 | | 4 | |
|---|---|---|---|---|---|---|---|---|
| Sample Identification | 1 | A | 2 | B | 3 | C | 4 | D |
| Stretch Ratio[1] | | | | | | | | |
| Stage 1 (54–55) | 1.118 | | 1.084 | | 1.186 | | 1.186 | |
| Stage 2 (55–56) | 1.109 | | 1.084 | | 1.157 | | 1.157 | |
| Stage 3 (56–57) | 1.089 | | 1.075 | | 1.142 | | 1.142 | |
| Overall (50–59) | 1.4 | | 1.3 | | 1.6 | | 1.6 | |
| Sheet Final Speed, m/min | 41.5 | | 39.0 | | 49.1 | | 49.1 | |
| Sheet Temperature[2], °C. | | | | | | | | |
| At Roll 53 | 132 | 132 | 132 | 132 | 137 | 137 | 137 | 137 |
| At Roll 54 | 105 | 130 | 105 | 130 | 127 | 133 | 127 | 134 |
| At Roll 55 | 119 | 131 | 119 | 131 | 129 | 132 | 129 | 132 |
| At Roll 56 | 116 | 131 | 116 | 131 | 129 | 131 | 125 | 131 |
| At Roll 57 | 123 | 131 | 123 | 131 | 126 | 130 | 126 | 130 |
| Sheet Characteristics | | | | | | | | |
| Unit weight, g/m² | | | | | | | | |
| Initial | 41.0 | 41.0 | 41.0 | 41.0 | 52.3 | 52.3 | 52.3 | 52.3 |
| Final | 34.9 | 32.9 | 35.6 | 35.6 | 39.7 | 36.3 | 32.2 | 33.9 |
| Tensile strength, N | | | | | | | | |
| Longitudinal | 104 | 86 | 110 | 118 | 153 | 152 | 131 | 162 |

TABLE II-continued

| | SUMMARY OF DATA | | | | | | | |
|---|---|---|---|---|---|---|---|---|
| Example | 1 | | 2 | | 3 | | 4 | |
| Sample Identification | 1 | A | 2 | B | 3 | C | 4 | D |
| Transverse | 63 | 52 | 58 | 58 | 57 | 50 | 41 | 47 |
| Break elongation, % | | | | | | | | |
| Longitudinal | 7.8 | 6.3 | 8.1 | 8.8 | 6.6 | 6.9 | 6.3 | 7.5 |
| Transverse | 22.4 | 17.6 | 19.8 | 17.9 | 18.9 | 19.1 | 13.1 | 15.4 |
| Tear strength, N | | | | | | | | |
| Longitudinal | 3.2 | 3.7 | 4.9 | 3.8 | 3.3 | 2.4 | 3.2 | 2.4 |
| Transverse | 3.6 | 4.4 | 3.6 | 3.8 | 4.0 | 3.9 | 4.0 | 3.2 |
| Delamination N/cm | 0.5 | 0.4 | 0.4 | 0.5 | 0.5 | 0.6 | 0.9 | 0.8 |
| Permeability[3] | 12.4 | 15.0 | 18.4 | 10.7 | 19.3 | 15.6 | 16.8 | 18.5 |
| Hydrostatic head, cm | nm | nm | nm | nm | 193 | 150 | 196 | 173 |
| Opacity, % | 85 | 86 | 88 | 85 | 82 | 79 | 82 | 78 |
| Final thickness | | | | | | | | |
| Average, mm | 0.11 | 0.10 | 0.12 | 0.10 | 0.10 | 0.10 | 0.10 | 0.09 |
| Uniformity, % CV[4] | 17.2 | 21.8 | 16.1 | 25.2 | 19.1 | 23.2 | 15.0 | 20.3 |

Notes:
[1]Stretch is the calculated longitudinal stretching and is the ratio of the fast-to-slow roll speed. The particular rolls involved in each stage, numbered in accordance with the attached drawing, are included in parentheses.
[2]The recorded temperature is the calculated temperature for the midplane of the sheet.
[3]Gurley-Hill permeability in sec/100 $cm^3/cm^2$.
[4]Thickness uniformity is expressed as a percentage coefficient of variation of measured thickness.
[5]"nm" means that no measurement was made.

I claim:

1. In a continuous process for bonding and stretching a fibrous polyolefin nonwoven sheet wherein the sheet is first heated to a bonding temperature that is near but below the melting point of the polyolefin, then is stretched in at least two stages to at least 1.2 times its original length and then is cooled to a temperature below 60° C., and wherein forces are applied perpendicular to the sheet surface during the heating, stretching and cooling when the sheet temperature is at 100° C. or higher, the improvement comprising decreasing the sheet temperature by 5° to 40° C. immediately after the heating to the bonding temperature and as the sheet is being forwarded to a first stretching stage and then alternately heating and cooling the sheet in subsequent stretching stages of the continuous process.

2. A process in accordance with claim 1 wherein the nonwoven sheet is formed of flash-spun, plexifilamentary film-fibril strands of linear polyethylene, the bonding temperature is within 3° to 8° C. below the melting point of the polyethylene, the sheet has a unit weight before stretching in the range of 35 to 70 g/$m^2$, the sheet is stretched longitudinally in two or three stages to 1.2 to 1.7 times its original length.

3. A process in accordance with claim 1 or 2 wherein the sheet temperature is decreased from the bonding temperature by 10° to 25° C. as the sheet is being forwarded to the first stretching stage.

4. A process in accordance with claim 1 or 2 wherein the alternate heating and cooling during the subsequent stretching increases the sheet temperature to no higher than the bonding temperature and decreases the sheet temperature to no lower than 100° C.

5. A process in accordance with claim 4 wherein the sheet temperature during the alternate heating and cooling varies by at least 5° C. but by no more than 35° C.

6. A process in accordance with claim 4 wherein the sheet temperature during the alternate heating and cooling varies by 10° to 25° C.

* * * * *